US006688449B1

(12) United States Patent
Yamagishi

(10) Patent No.: US 6,688,449 B1
(45) Date of Patent: Feb. 10, 2004

(54) IMAGE PICKUP DEVICE AND PATTERN IDENTIFICATION APPARATUS

(75) Inventor: Junichi Yamagishi, Sendai (JP)

(73) Assignee: Unirec Co., Ltd., Tokyo (JP)

( * ) Notice: Subject to any disclaimer, the term of this patent is extended or adjusted under 35 U.S.C. 154(b) by 80 days.

(21) Appl. No.: 09/652,680

(22) Filed: Aug. 31, 2000

(30) Foreign Application Priority Data

Dec. 10, 1999 (JP) ..... 11-351108
Mar. 30, 2000 (JP) ..... 2000-094581

(51) Int. Cl.[7] ..... G07D 5/00

(52) U.S. Cl. ..... 194/328; 194/303; 194/317; 194/330; 382/136; 382/194; 382/196; 382/203

(58) Field of Search ..... 194/317, 328, 194/330; 382/135, 136, 137, 194, 203, 196

(56) References Cited

U.S. PATENT DOCUMENTS 3,797,628 A * 3/1974 Fougere et al. ..... 195/324
4,491,963 A * 1/1985 Bellemare ..... 358/461
4,567,609 A * 1/1986 Metcalf ..... 382/105
4,718,090 A * 1/1988 Cooper, Jr. ..... 358/433
5,224,176 A * 6/1993 Crain ..... 382/136
5,494,147 A * 2/1996 Takahashi et al. ..... 194/328
5,538,123 A * 7/1996 Tsuji ..... 194/303
5,987,162 A * 11/1999 Nakata ..... 382/141
6,328,150 B1 * 12/2001 Hibari ..... 194/317
6,417,841 B1 * 7/2002 Doi et al. ..... 345/158

FOREIGN PATENT DOCUMENTS

JP 08016869 1/1996
JP 10083471 3/1998

* cited by examiner

*Primary Examiner*—Donald P. Walsh
*Assistant Examiner*—Jeffrey A. Shapiro
(74) *Attorney, Agent, or Firm*—Kilpatrick Stockton LLP

(57) ABSTRACT

A pattern identification apparatus is used to speedily identify tokens at a game arcade. The apparatus is inexpensive and has an image pickup device (15). The image pickup device has an area sensor (17) consisting of a two-dimensional matrix of photoelectric pixels. Each of the photoelectric pixels has a photodiode (19), a signal comparator (21), and a signal holder (23). The photoelectric pixels are connected to address lines (5), respectively. Required ones of the address lines are specified. Signals are read, to a data line, out of the signal holders of the photoelectric pixels that are connected to the specified address lines in response to addressing signals passed through the specified address lines. The specified address lines correspond to concentric circles (45, 47, 49) defined on a target (39) of disk shape. The target is identified according to the read signals that represent the concentric circles defined on the target.

3 Claims, 8 Drawing Sheets

IMAGE PICKUP DEVICE AND PATTERN IDENTIFICATION APPARATUS

BACKGROUND OF THE INVENTION

1. Field of the Invention

The present invention relates to an image pickup device and a pattern identification apparatus.

2. Description of the Related Art

Tokens used for game machines such as slot machines installed in a game arcade are lent to players by the game arcade at a predetermined rate. The lent tokes are strictly prohibited from taking them outside the game arcade. Some players, however, receive tokens at one game arcade and bring them to another game arcade to use them at there. Then, tokens of different game arcades may be mixed at each game arcade.

Any game arcade that wants to strictly manage its own tokens must spend a long time to remove foreign tokens from tokens collected from game machines installed in the game arcade. Some game arcades employ tokens of special composition or of a special shape to reject different tokens at the slots of game machines.

The technique of employing tokens of special composition has a limitation that it can distinguish only about seven different compositions from one another at present. The technique of employing tokens of a special shape also has a limitation that it is unable to adopt extremely deformed shapes because the tokens must be passed through a counter and a hopper. Accordingly, these techniques provide limited combinations of usage. To reject foreign tokens at each game arcade located in a given area, the game arcades must cooperate together to adopt individual tokens. This involves the necessity of new tokens and large cost. Accordingly, these techniques are not practical.

At present, the most effective way to identify tokens that are specific to a given game arcade is to form a pattern that is specific to the game arcade on the tokens, read a pattern on each token, and check the read pattern. This technique is achievable with an image processing apparatus employing an image pickup device, such as that disclosed in Japanese Unexamined Patent Publication No. Hei 11-177893. The apparatus of this disclosure has an area sensor composed of a two-dimensional matrix of pixels and employs a frame reading technique that sequentially reads the area sensor line by line and carries out image processing. This apparatus needs a long processing time and is large and expensive.

Game arcades that handle many tokens need high-speed processing, and the above disclosure is incapable of achieving such high-speed processing. In addition, the large size and expensiveness of the above disclosure are impractical for game arcades.

SUMMARY OF THE INVENTION

An object of the present invention is to provide an image pickup device that operates at high speed and is manufacturable at low cost and a pattern identification apparatus employing the image pickup device.

In order to accomplish the object, a first aspect of the present invention provides an image pickup device having an area sensor composed of a two-dimensional matrix of photoelectric pixels. Each of the photoelectric pixels has a photoelectric converter for forming an optical image, a signal comparator for comparing a charge representative signal from the photoelectric converter with a reference signal and providing a resultant signal, and a signal holder for holding the resultant signal. The photoelectric pixels are connected to address lines, respectively. Required ones of the address lines are specified, and signals are read, to a data line, out of the signal holders of the photoelectric pixels that are connected to the specified address lines in response to addressing signals passed through the specified address lines.

A second aspect of the present invention provides a pattern identification apparatus employing an image pickup device. The image pickup device has an area sensor composed of a two-dimensional matrix of photoelectric pixels. Each of the photoelectric pixels has a photoelectric converter for forming an optical image, a signal comparator for comparing a charge representative signal from the photoelectric converter with a reference signal and providing a resultant signal, and a signal holder for holding the resultant signal. The photoelectric pixels are connected to address lines, respectively. Required ones of the address lines are specified, and signals are read, to a data line, out of the signal holders of the photoelectric pixels that are connected to the specified address lines in response to addressing signals passed through the specified address lines. The specified address lines correspond to concentric circles defined on a target of disk shape. The target is identified according to the read signals that represent the concentric circles defined on the target.

A third aspect of the present invention provides the pattern identification apparatus of the second aspect with a path for moving each target with respect to the area sensor at a constant speed. The address lines to be specified are determined by detecting a first one among the photoelectric pixels that first provides an image of the target, by finding, on the area sensor, a relative center that corresponds to the center of the target according to the position of the first photoelectric pixel and the moving speed of the target, and by using the relative center.

A fourth aspect of the present invention provides an identification apparatus having a material identification unit for identifying the material of a target moving along a path and a pattern identification unit for identifying patterns on the target. The material identification unit has a material sensor for providing an output that represents the material of the target, a speed sensor for providing an output that represents the speed of the target moving along the path, and a material identifying unit for identifying the material of the target according to the outputs of the material sensor and speed sensor. The pattern identification unit has an area sensor having a two-dimensional matrix of photoelectric pixels. Each of the photoelectric pixels has a photoelectric converter for forming an optical image, a signal comparator for comparing a charge representative signal from the photoelectric converter with a reference signal and providing a resultant signal, and a signal holder for holding the resultant signal. The photoelectric pixels are connected to address lines, respectively. The pattern identification unit specifies required ones of the address lines. Signals are read, to a data line, out of the signal holders of the photoelectric pixels that are connected to the specified address lines in response to addressing signals passed through the specified address lines. The specified address lines correspond to concentric circles defined on the target. The pattern identification unit identifies the target according to the read signals that represent the concentric circles defined on the target.

According to the first aspect, the photoelectric converter of each photoelectric pixel forms an optical image, the signal comparator compares a charge representative signal from the photoelectric converter with a reference signal, and the signal holder holds an output signal from the signal comparator. Among the address lines connected to the photoelectric pixels, specific ones are specified. In response to addressing signals passed through the specific address lines, signals are transferred from the signal holders addressed by the addressing signals to a data line. Instead of reading signals from all photoelectric pixels in the area sensor, the first aspect reads signals only from specific pixels in the area sensor As a result, the first aspect needs no image processing circuit because it identifies a target pattern according to specific photoelectric pixels. This technique improves a processing speed and reduces the cost of the image pickup device.

According to the second aspect, address lines corresponding to concentric circles defined on a target of disk shape are specified. In response to addressing signals passed through the specified address lines, data related to the concentric circles is read. The read data is used to correctly identify the target at high speed without image processing. The apparatus of the second aspect is manufacturable at low cost because it needs no image processing.

According to the third aspect, the position of a photoelectric pixel in the area sensor that first encounters a target and the moving speed of the target are used to find a relative center on the area sensor that corresponds to the center of the target. According to the relative center, specific address lines are specified. Even if the target is off the center of the path for moving the target, the third aspect is capable of correctly finding the center of the target and correctly obtaining data related to concentric circles defined on the target, thereby correctly identifying the target.

According to the fourth aspect, the material identification unit identifies the material of a target according to the outputs of the material sensor and speed sensor. The pattern identification unit specifies address lines corresponding to concentric circles defined on the target which has a disk shape. In response to addressing signals passed through the specified address lines, the pattern identification unit reads data related to the concentric circles, and according to the read data, correctly identifies the target at high speed without image processing.

Consequently, the fourth aspect correctly determines whether or not the target is genuine and/or the characteristics of the target according to both the material and patterns of the target.

DESCRIPTION OF THE PREFERRED EMBODIMENTS

Figure 1:
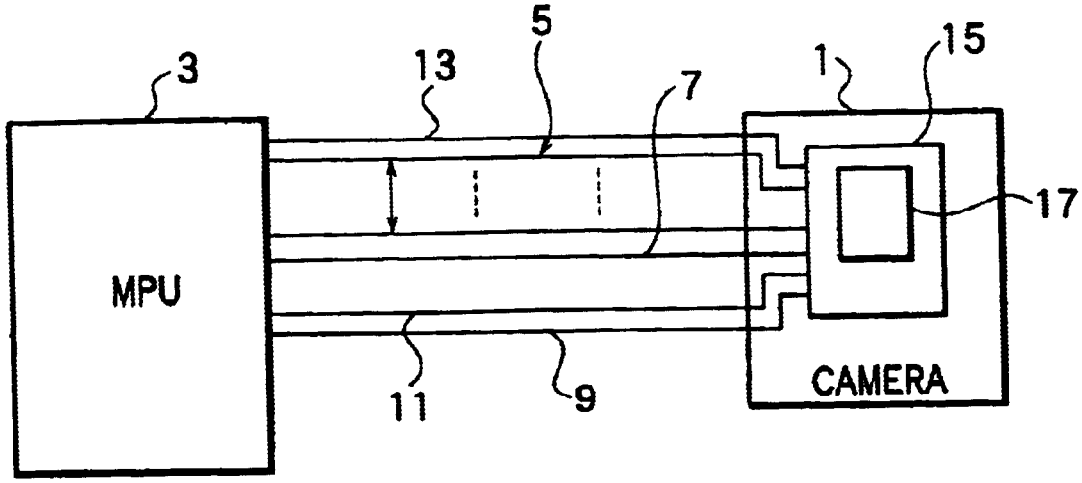
FIG. 1 is a block diagram generally showing an image pickup device according to an embodiment of the present invention.

FIG. 1 is a block diagram showing an image pickup device according to an embodiment of the present invention. A cameral 1 is connected to a microprocessor unit (MPU) 3 through address lines 5, a reset line 7, a data line 9, a chip select line 11, and a shutter line 13.

The camera 1 has the image pickup device 15 having an area sensor 17. The image pickup device 15 is of, for example, CMOS type. The image pickup device 15 may be of CCD type.

The area sensor 17 consists of photoelectric pixels or unit cells arranged in a two-dimensional matrix of, for example, several hundred pieces by several hundred pieces.

Figure 2:
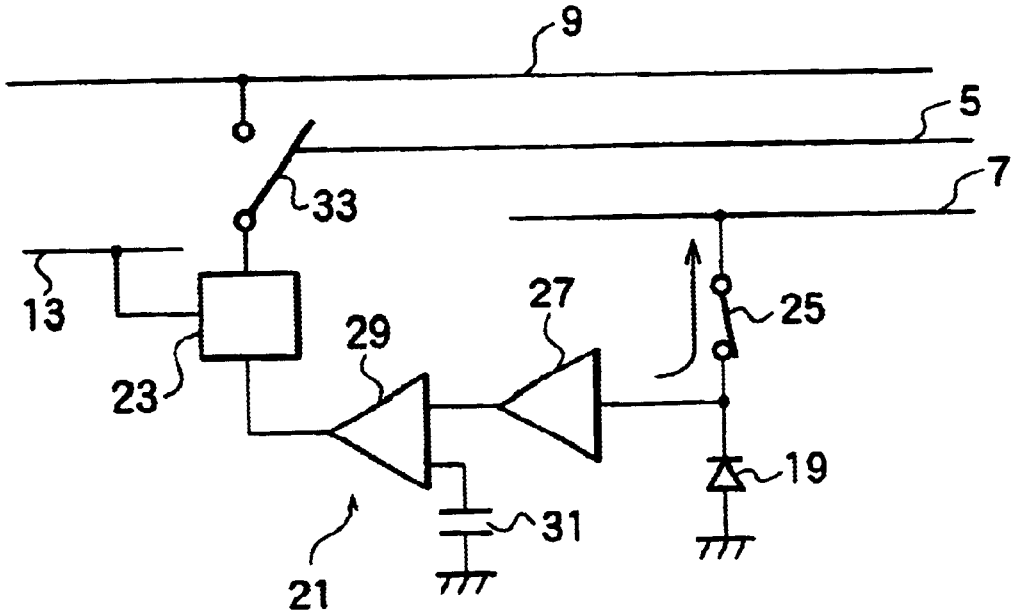
FIG. 2 is a circuit diagram showing a unit cell of the image pickup device.

FIG. 2 shows the structure of a unit cell in the area sensor 17. The unit cell consists of a photodiode 19 serving as a photoelectric converter, a signal comparator 21 for comparing a charge representative signal from the photodiode 19 with a reference signal and providing a resultant signal, and a signal holder 23 for holding the resultant signal.

The photodiode 19 detects incident light and forms an optical image. The photodiode 19 generates a signal in response to charge that corresponds to the amount of incident light. The photodiode 19 is connected to a reset transistor 25 that is connected to the reset line 7. In this embodiment, the reset line 7 is single and is connected to all photodiodes 19 in the area sensor 17.

The signal comparator 21 consists of an amplifier 27 and a comparator 29. The amplifier 27 amplifies a charge representative signal from the photodiode 19 and transfers the amplified signal to the comparator 29. The comparator 29 compares the amplified signal with a reference signal from a reference voltage generator 31 and provides a signal of "1" or "0" depending on the level of charge at the photodiode 19.

The reference voltage generator 31 may be provided for each unit cell. Alternatively, a common reference voltage may be pulled from the outside through a line. The reference voltage may be variable.

The signal holder 23 is, for example, a D-type flip-flop and is connected to a read transistor 33, which is connected to the data line 9. In this embodiment, the data line 9 is single and is connected to the signal holders 23 of all unit cells.

The signal holder 23 is connected to the shutter line 13. In this embodiment, the shutter line 13 is single and is connected to the signal holders 23 of all unit cells. The shutter line 13 serves as an electronic shutter and operates on a clock signal that provides the timing of $1/1000$ seconds to $1/4000$ seconds. Based on this timing, the signal holder 23 holds a signal of "1" or "0" from the comparator 29.

The read transistor 33 is connected to one of the address lines 5. The address lines 5 are connected to the unit cells, respectively. Necessary ones of the address lines 5 are specified by a decoder (not shown) incorporated in the MPU 3 in synchronization with, for example, the clock signal.

The chip select line 11 is switched between high and low levels. When the chip select line 11 is high, the data line 9 is high.

When a reset pulse is applied to the reset line 7, the reset transistor 25 turns on to discharge the photodiode 19, thereby resetting the photodiode 19. Thereafter, the photodiode 19 forms an optical image and accumulates charge to produce a charge representative signal. The charge representative signal is amplified by the amplifier 27, and the amplified signal is compared with the reference voltage by the comparator 29, which provides a signal of "1" or "0" accordingly. This signal is held by the signal holder 23 in response to the clock signal from the shutter line 13.

Figure 3:
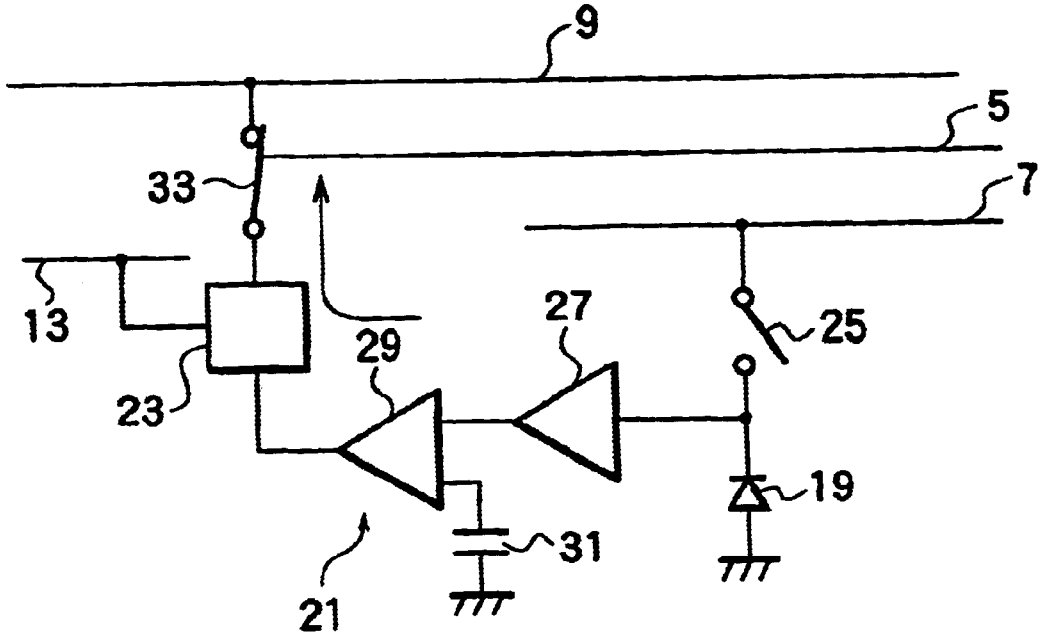
FIG. 3 is a circuit diagram showing the operation of the unit cell.

The MPU 3 specifies required ones of the address lines 5 and sequentially provides addressing signals to the specified address lines 5 in synchronization with the clock signal. The addressing signals turn on the read transistors 33 connected to the specified address lines 5, and each of the turned-on read transistors 33 transfers a signal from the signal holder 23 to the data line 9, as shown in FIG. 3.

In this way, necessary ones of the address lines 5 are specified, and addressing signals are supplied to the specified address lines 5 to read data only from required photoelectric pixels to the data line 9.

The data read to the data line 9 is processed and compared as explained below, to identify a pattern on the surface of a target token. This technique is faster than the conventional image processing that entirely reads each frame, in terms of read speed and signal processing. The present invention processes only signals from the data line 9 without carrying out special image processing, and therefore, the apparatus of the present invention is simple, small, and low-cost.

FIGS. 4 to 7 show a pattern identification apparatus, in particular, a token identification apparatus employing the image pickup device mentioned above.

Figure 4:
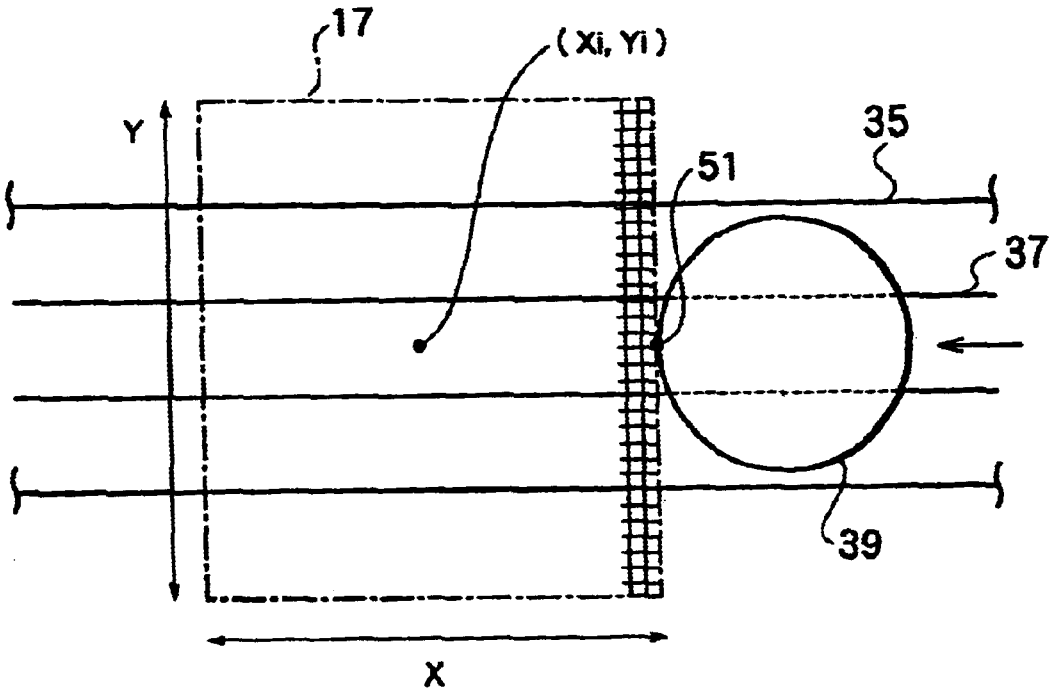
FIG. 4 is a plan view showing a pattern identification apparatus employing the image pickup device.

FIG. 4 shows a relationship between the area sensor 17 of the image pickup device and a path 35 having a belt 37 for conveying tokens. A token 39 serving as a target has a disk shape and is moved on the belt 37 in an arrow direction along the path 35 at a constant speed.

Figure 5:
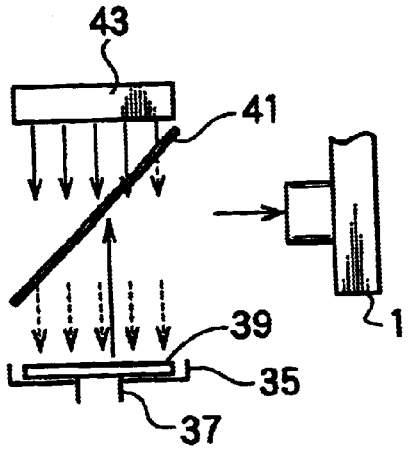
FIG. 5 shows an arrangement of the pattern identification apparatus.

FIG. 5 shows a positional relationship between the camera 1 incorporating the area sensor 17 and the path 35. A half-mirror 41 is arranged above the path 35 at an angle of 45 degrees. A light 43 is arranged above the half-mirror 41. The camera 1 is arranged beside the half-mirror 41.

Light from the light 43 passes through the half-mirror 41, is reflected by the token 39 and by the half-mirror 41, and enters the camera 1. This arrangement of the camera 1 and light 43 is compact around the path 35. If space allows, the half-mirror 41 may be omitted.

Figure 6:
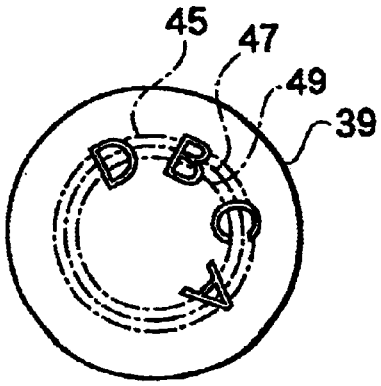
FIG. 6 is a plan view showing a token.
Figure 7:
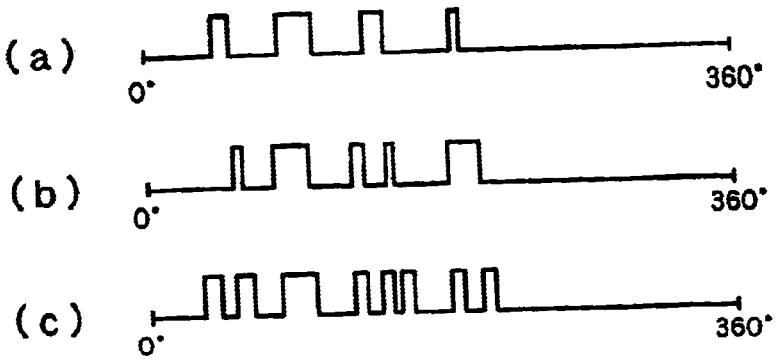
FIG. 7 shows data related to concentric circles defined on the token.

FIG. 6 shows three concentric circles 45, 47, and 49 defined on the token 39. These concentric circles correspond to specific ones among the address lines 5. In response to addressing signals passed through the specific address lines 5, data about the concentric circles 45, 47, and 49 is read to identify the token 39. FIG. 7 shows examples of data related to the concentric circles 45, 47, and 49. FIG. 7(*a*) corresponds to the concentric circle 45, FIG. 7(*b*) the concentric circle 47, and FIG. 7(*c*) the concentric circle 49. In FIG. 6, characters "DBCA" protrude from the surface of the token 39, and therefore, the characters reflect light stronger than the other part of the token 39, to provide a pulse of "1" in FIG. 7. At this time, the other part of the token provides "0." If the characters are carved in the token 39, they provide "0" and the other part "1." This embodiment uses three concentric circles for each target to correctly identify the target. The number of concentric circles may be one, two, four, or more depending on required correctness.

If the token 39 is shifted from the path 35 in a Y-direction in FIG. 4, the concentric circles 45, 47, and 49 are shifted from the area sensor 17 accordingly, so that the specific address lines 5 may not correspond to the concentric circles 45, 47, and 49. In this case, address lines 5 that correctly correspond to the concentric circles 45, 47, and 49 are found as mentioned below.

When the token 39 is conveyed with respect to the area sensor 17 as shown in FIG. 4, a photoelectric pixel 51 in the area sensor 17 that first encounters the token 39 is detected. Since the belt 37 carries the token 39 at a constant speed, the position of the photoelectric pixel 51 and the speed of the belt 37 are usable to calculate a relative center (Xi, Yi) on the area sensor 17 corresponding to the center of the token 39. According to the relative center (Xi, Yi), address lines 5 corresponding to the concentric circles 45, 47, and 49 defined on the token 39 are determined. This determination is carried out by the MPU 3, and the MPU 3 provides the decoder with a signal accordingly, to fetch data from photoelectric pixels, which are addressed by the determined address lines 5, through the data line 9 as shown in FIG. 7.

Initially, a genuine token 39 is used to measure reference data, and the reference data is stored in a memory. Then, data is obtained from a target token and is compared with the reference data. If the, data from the target token agrees with the reference data, the target token is genuine, and if not, the target token is false.

Each token 39 on the path 35 has an individual angular position, and therefore, simply comparing data from the token with the reference data is insufficient to determine whether or not the token is genuine. The present invention samples 360-degree data from the concentric circles 45, 47, and 49 defined on each target token. The MPU 3 adjusts the rotational angle of each piece of the 360-degree data and determines whether or not the target token is genuine.

Consequently, the present invention enables each game arcade to easily distinguish foreign tokens from its own tokens among tokens used for game machines such as slot machines.

A conventional image processing technique that entirely reads a frame of an area sensor whose size is equal to the area sensor 17 of the present invention needs a read time of about 30 milliseconds for each token, and therefore, the conventional technique is capable of checking only 10 to 12 tokens per second. The present invention is capable of more quickly checking tokens. If the three concentric circles 45, 47, and 49 defined on each token involve 768 sampling points, the present invention needs a unit-cell access time of only 50 to 100 nanoseconds and a total read time of 38,400 to 76,800 nanoseconds. Namely, the present invention is capable of checking about 100 tokens per second. In this way, the token identification apparatus of the present invention checks tokens at high speed and is compact because it carries out no image processing.

Figure 8:
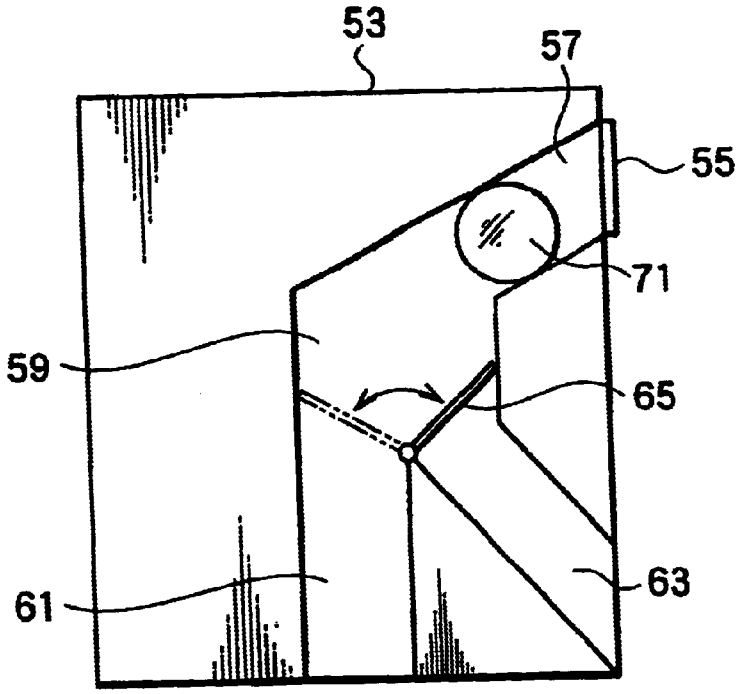
FIG. 8 is a sectional view showing a coin selector employing the image pickup device of the present invention.
Figure 9:
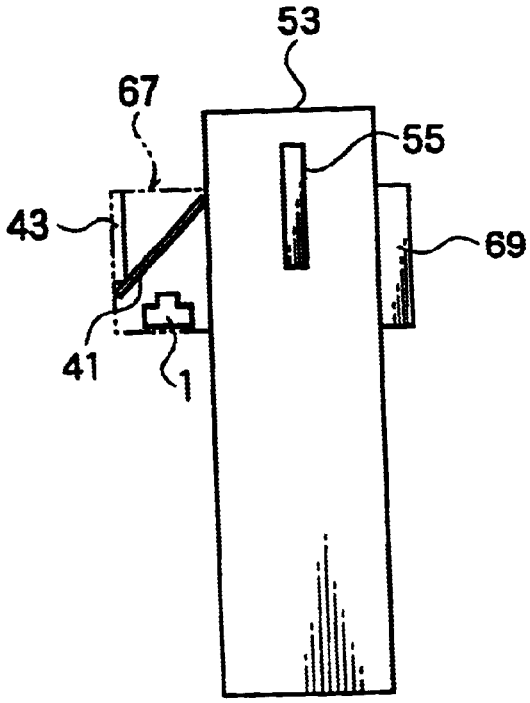
FIG. 9 is a side view showing the coin selector.

FIGS. 8 and 9 show a coin selector employing the image pickup device of the present invention, in which FIG. 8 is a sectional view and FIG. 9 is a side view. The coin selector has a housing 53 provided with a slot 55. The slot 55 connects to an identification path 57. At a lower part of the path 57, there is a select part 59. At a lower part of the select part 59, there are a true coin path 61 and a reject path 63. A shutter 65 is arranged between the paths 61 and 63, to selectively close one of the paths 61 and 63 in response to a command.

In FIG. 9, a coin identification apparatus 67, i.e., the pattern identification apparatus of the present invention is arranged beside the path 57. On the opposite side of the path 57, there is a metal sensor 69. The apparatus 67 has a camera 1, a lamp 43, and a half-mirror 41.

A target 71 is inserted into the slot 55, and in the path 57, is checked by the apparatus 67 for a pattern on the target 71 and by the metal sensor 69 for the alloy composition of the target 71, to correctly determine whether or not the target 71 is genuine. The apparatus 67 according to the present invention is compact, and therefore, the whole apparatus of FIGS. 8 and 9 is also compact.

Figure 10:
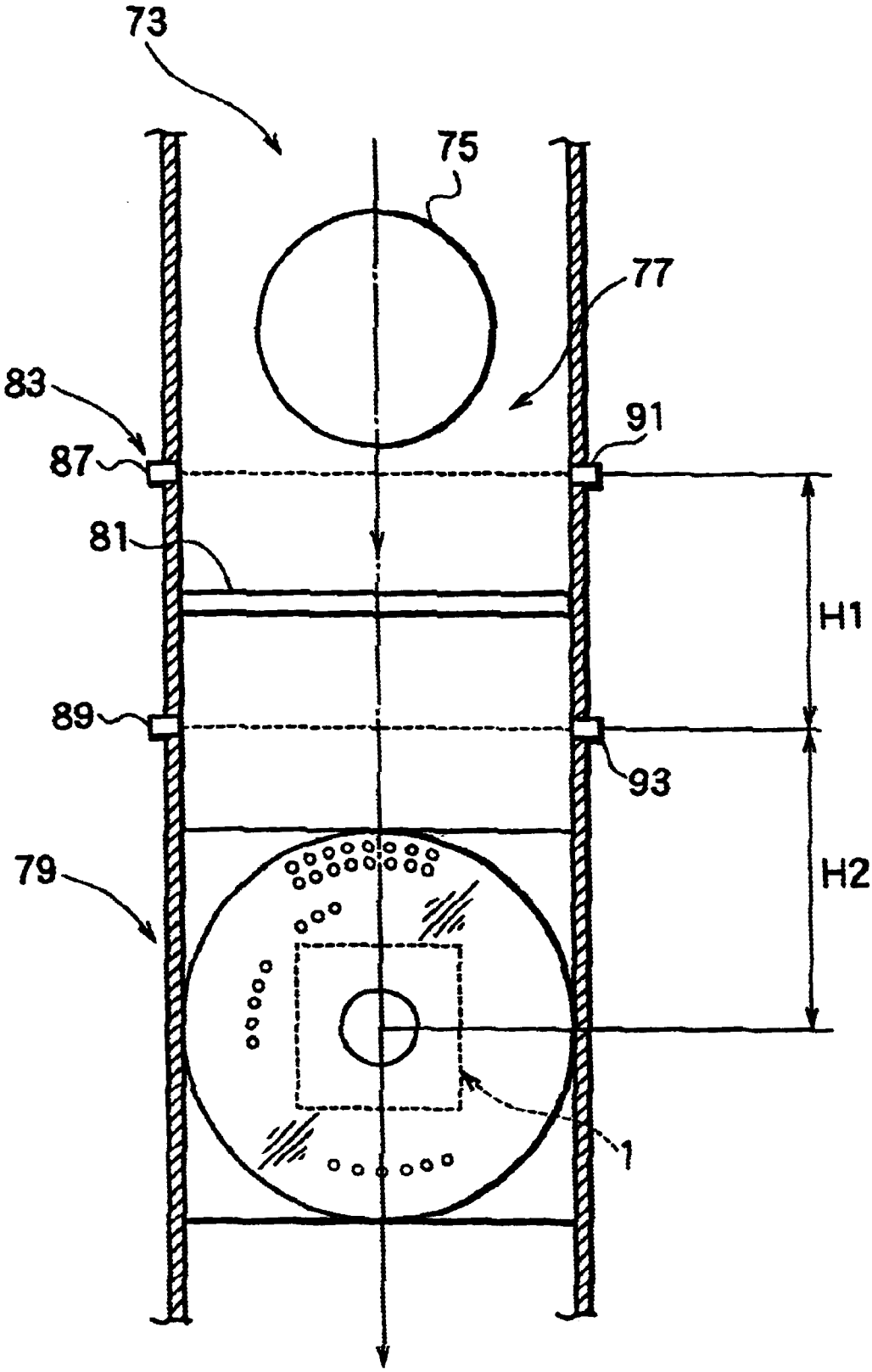
FIG. 10 is a sectional front view showing a coin identification apparatus according to another embodiment of the present invention.
Figure 11:
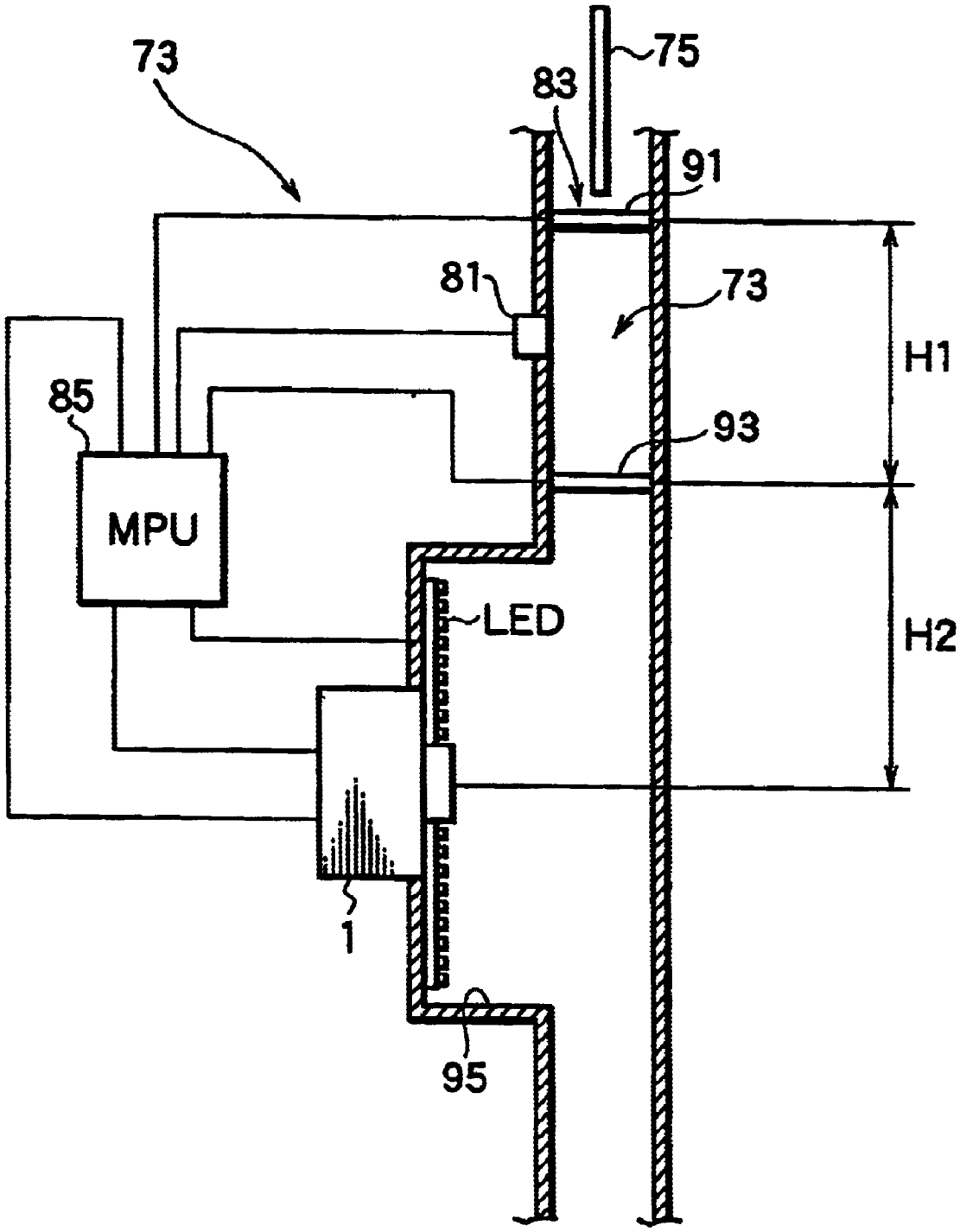
FIG. 11 is a sectional side view showing the apparatus of FIG. 10.
Figure 12:
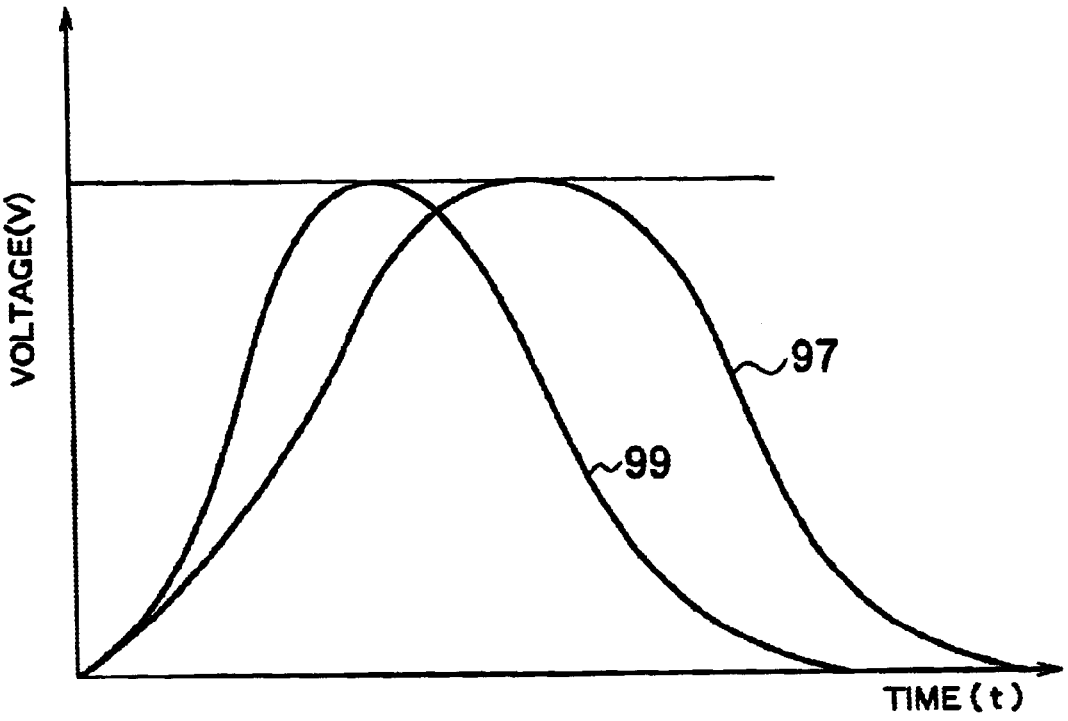
FIG. 12 is a graph showing voltage curves representing the output of a material sensor of the apparatus of FIG. 10.

FIGS. 10 to 12 show a coin identification apparatus according to another embodiment of the present invention, in which FIG. 10 is a sectional front view showing a coin path of the apparatus, FIG. 11 is a sectional side view showing the coin path, and FIG. 12 is a graph showing voltage curves detected by the apparatus.

The coin identification apparatus of this embodiment has the coin path 73 along which a coin 75 falls, a material identification unit 77 for identifying the material of the coin 75, and a pattern identification unit 79 for identifying patterns on the coin 75.

The material identification unit 77 has a material sensor 81, a speed sensor 83, and a material determination unit 85. The material sensor 81 changes the output thereof in response to the material of a coin falling along the path 73 and is made of, for example, a magnetic sensor.

The speed sensor 83 detects the falling speed of an object that falls along the path 73. The speed sensor 83 consists of, for example, a pair of light emitting elements 87 and 89 arranged on one side of the path 73, and a pair of light receiving elements 91 and 93 arranged on the opposite side of the path 73. The detective range of the elements 87, 89, 91, and 93 is, for example, the width of the path 73. The distance between the upper elements 87 and 91 and the lower elements 89 and 93 is "H1."

The material determination unit 85 is a microprocessor unit (MPU) 85 that receives output signals from the material sensor 81 and speed sensor 83 and determines the material of the coin 73 accordingly. The MPU 85 is connected to the material sensor 81, light emitting elements 87 and 89, and light receiving elements 91 and 93.

The pattern identification unit 79 has the same structure as that of the previous embodiment and has a camera 1 that is connected to input and output ports of the MPU 85.

The camera 1 forms an optical image through light emitting diodes (LEDs). The camera 1 is arranged in a recess 95 formed on one side of the path 73, and the LEDs are arranged around the camera 1 on the surface of a support disk 97. A light emitting period of the LEDs is controlled by the MPU 85 and is set to be equal to an exposure period of the camera 1. The exposure timing of the camera 1 is the timing when the center of the coin 75 comes onto the center of the camera 1 and is detected by using the lower light emitting element 89 and light receiving element 93. The distance between the element 89 or 93 and the center of the camera 1 is "H2." The elements 89 and 93 detect the timing when the coin 75 passes between the elements 89 and 93, and the detected timing and the distance H2 are used by the MPU 85 to calculate the timing when the center of the coin 75 comes onto the center of the camera 1. A combination of the camera 1, LEDs, and timing detecting structure is applicable to the pattern identification apparatus and coin selector explained above.

The coin 75 is inserted into the apparatus through a slot, and at a predetermined position, starts to fall along the path 73. When the coin 75 passes in front of the material sensor 81, the output of the material sensor 81 changes accordingly. FIG. 12 shows an example of a change in the output of the material sensor 81.

In FIG. 12, a change in the output of the material sensor 81 is detected as a temporal voltage change. Even objects of the same material produce different voltage curves because their speeds of crossing the material sensor 81 differ from one another. An object of slow speed may produce a curve 97 of FIG. 12, and an object of fast speed may produce a curve 99 of FIG. 12. Although the curves 97 and 99 have the same peak voltage, the curve 99 shows a steeper rise. Different coins such as 5-yen, 10-yen, 50-yen, 100-yen, and 500-yen coins show different peak voltages because they are made of different materials. Voltage curves are measured in advance for various coins of different denominations at different falling speeds, and the measured curves are stored as reference curves in the MPU 85.

The speed of the coin 75 falling in front of the material sensor 81 is detected by the speed sensor 83. The light emitting elements 87 and 89 emit beams, which are received by the light receiving elements 91 and 93. When the coin 75 successively blocks the beams from the elements 87 and 89, the elements 91 and 93 send corresponding signals to the MPU 85, which calculates the speed of the coin 75 according to the signals and the distance H1 stored therein.

When the coin 75 falls in front of the material sensor 81, the output of the material sensor 81 changes. Such a change is compared with the reference curves stored in the MPU 85, and the MPU 85 determines whether or not the coin 75 is genuine and the denomination of the coin 75. The condition of inserting the coin 75 into the apparatus is not always the same, and therefore, the falling speed of the coin 75 is not always the same. Even so, the MPU 85 considers the output of the speed sensor 83 when comparing the output of the material sensor 81 with the stored reference curves, to correctly determine whether or not the coin 75 is genuine and the denomination of the coin 75.

According to the detection of the coin 75 by the elements 89 and 93 and the distance H2, the MPU 85 calculates the timing when the center of the coin 75 agrees with the center of the camera 1. At this timing, the MPU 85 exposes the camera 1 and energizes the LEDs. The camera 1 forms an optical image of the coin 75, and the MPU 85 compares concentric patterns in the image with reference patterns and determines whether or not the coin 75 is genuine and the denomination of the coin 75, like the previous embodiment.

In addition to the effect of the previous embodiment, this embodiment provides an effect of correctly determining whether or not a given coin is genuine and the denomination of the coin according to both the material and patterns of the coin.

Although this embodiment handles coins, it may handle other objects such as tokens. Although this embodiment determines whether or not a given coin is genuine and the denomination of the coin, the embodiment may determine only whether or not a given coin is genuine or only the denomination of a given coin.

Although the present invention has been explained with reference to the token identification apparatus and coin identification apparatus, the present invention is applicable to identify any other objects such as obstacles around a car.

What is claimed is:

1. An image pickup device comprising an area sensor composed of a two-dimensional matrix of photoelectric pixels, wherein:

each of the photoelectric pixels has a photoelectric converter for forming an optical image, a signal comparator for comparing a charge representative signal from the photoelectric converter with a reference signal and providing a resultant signal, and a signal holder for holding the resultant signal;

the photoelectric pixels are connected to address lines, respectively;

the photoelectric pixels are arranged in a two-dimensional matrix over a path along which disk objects are moved at a constant speed;

whenever a disk object moving along the path comes to the area sensor a position on the area sensor is estimated according to a moving speed of the disk object, a position of a first one of the photoelectric pixels that first provides an image of an outermost circumferential edge of the disk object, and a radius of an outermost circumferential edge of a reference disk stored in advance, the estimated position on the area sensor being on a line extended from the first photoelectric pixel along the path and being expected to meet the center of the disk object;

at least one concentric circle is defined around the estimated position on the area sensor and address lines corresponding to the defined concentric circle are determined;

when the center of the disk object meets the estimated position on the area sensor while the disk object continuously moving along the path, signals from the photoelectric pixels passed through the signal comparators are stored in the signal holders; and the signals stored in the signal holders are read to a data line only from the signal holders of the photoelectric pixels that are specified by addressing signals passed through the determined address lines corresponding to the defined concentric circle.

2. A pattern identification apparatus comprising an image pickup unit and a pattern identification unit, wherein:

the image pickup unit has an area sensor composed of a two-dimensional matrix of photoelectric pixels;

each of the photoelectric pixels has a photoelectric converter for forming an optical image, a signal comparator for comparing a charge representative signal from the photoelectric converter with a reference signal and providing a resultant signal, and a signal holder for holding the resultant signal;

the photoelectric pixels are connected to address lines, respectively;

the photoelectric pixels are arranged in a two-dimensional matrix over a path along which disk objects are moved at a constant speed;

whenever a disk object moving along the path comes to the area sensor, a position on the area sensor is estimated according to a moving speed of the disk object, a position of a first one of the photoelectric pixels that first provides an image of an outermost circumferential edge of the disk object, and a radius of an outermost circumferential edge of a reference disk stored in advance, the estimated position on the area sensor being on a line extended from the first photoelectric pixel alone the path and being expected to meet the center of the disk object;

at least one concentric circle is defined around the estimated position on the area sensor and address lines corresponding to the defined concentric circle are determined;

when the center of the disk object meets the estimated position on the area sensor while the disk object continuously moving along the path, signals from the photoelectric pixels passed through the signal comparators are stored in the signal holders;

the signals stored in the signal holders are read to a data line only from the signal holders of the photoelectric pixels that are specified by addressing signals passed through the determined address lines corresponding to the defined concentric circle; and the pattern identification unit identifies the disk object according to the signals read to the data line.

3. An identification apparatus comprising material identification means for identifying the material of a disk object moving along a path and pattern identification means for identifying patterns on the disk object, wherein:

the material identification means has:

a material sensor for providing an output that represents the material of the disk object;

a speed sensor for providing an output that represents the speed of the disk object moving along the path; and a material identifying unit for identifying the material of the disk object according to the outputs of the material sensor and speed sensor;

the pattern identification means has:

an image pickup unit having an area sensor composed of a two-dimensional matrix of photoelectric pixels;

each of the photoelectric pixels has a photoelectric converter for forming an optical image, a signal comparator for comparing a charge representative signal from the photoelectric converter with a reference signal and providing a resultant signal, and a signal holder for holding the resultant signal;

the photoelectric pixels are connected to address lines, respectively;

the photoelectric pixels are arranged in a two-dimensional matrix over a path along which disk objects are moved at a constant speed;

whenever a disk object moving along the path comes to the area sensor, a position on the area sensor is estimated according to a moving speed of the disk object, a position of a first one of the photoelectric pixels that first provides an image of an outermost circumferential edge of the disk object, and a radius of an outermost circumferential edge of a reference disk stored in advance, the estimated position on the area sensor being on a line extended from the first photoelectric pixel along the path and being expected to meet the center of the disk object;

at least one concentric circle is defined around the estimated position on the area sensor and address lines corresponding to the defined concentric circle are determined;

when the center of the disk object meets the estimated position on the area sensor while the disk object continuously moving along the path, signals from the photoelectric pixels passed through the signal comparators are stored in the signal holders;

the signals stored in the signal holders are read to a data line only from the signal holders of the photoelectric pixels that are specified by addressing signals passed through the determined address lines corresponding to the defined concentric circle; and a pattern identification unit to identify the disk object according to signals read to the data line.

* * * * *